US005129164A

United States Patent [19]

Painter et al.

[11] Patent Number: 5,129,164

[45] Date of Patent: Jul. 14, 1992

[54] PORTABLE GRAIN HANDLING BIN

[76] Inventors: James M. Painter, Rte. 3, Box 110; Walter F. Priestly, 306 Ashburn Ave., both of Robstown, Tex. 78380

[21] Appl. No.: 517,768

[22] Filed: May 2, 1990

[51] Int. Cl.[5] ..... F26B 11/12

[52] U.S. Cl. ..... 34/181; 34/179; 34/236; 34/182; 414/526

[58] Field of Search ..... 34/179, 181, 182, 204, 34/102, 236, 90, 135; 98/55; 414/526, 287, 306; 222/410, 608

[56] References Cited

U.S. PATENT DOCUMENTS

| | | | |
|---|---|---|---|
| 2,060,652 | 11/1936 | Arnold | 414/526 |
| 3,166,386 | 1/1965 | Maksymec | 34/181 |
| 3,302,297 | 2/1967 | Graham | 34/102 |
| 3,309,782 | 3/1967 | Ellis | 34/179 |
| 3,330,050 | 7/1967 | Ausherman | 34/182 |
| 3,638,331 | 2/1972 | Steffen | 34/231 |
| 3,726,024 | 4/1973 | Erwin | 34/236 |
| 4,010,552 | 3/1977 | Peterson | 34/179 |
| 4,050,164 | 9/1977 | Campbell | 34/182 |
| 4,071,226 | 1/1978 | Miller | 414/526 |
| 4,095,705 | 6/1978 | Hood | 414/526 |
| 4,128,948 | 12/1978 | Wood | 34/181 |
| 4,142,302 | 3/1979 | Primus | 34/181 |
| 4,159,580 | 7/1979 | Welch, Jr. | 34/181 |

*Primary Examiner*—Henry A. Bennet
*Assistant Examiner*—Denise L. F. Gromada
*Attorney, Agent, or Firm*—G. Turner Moller

[57] ABSTRACT

A portable grain bin comprises a wheeled frame in which the wheels are movable relative to the frame to sit the frame on the ground and thereby transfer the load of material in the bin to the ground. The bin is grossly asymmetric with a bottom discharge much closer to one end than to other. The bottom wall nearest the bottom discharge is very steep. The bottom wall opposite the bottom discharge is relatively shallow but still exceeds a normal angle of repose of grain placed in the bin. The bottom discharge includes an opening spanned by a series of stationary slats and a movable member comprising a frame having a series of complementary slats which selectively align with or are offset from the stationary slats. The grain bin is used with a batch type grain dryer to provide surge capacity in a harvesting operation.

9 Claims, 3 Drawing Sheets

PORTABLE GRAIN HANDLING BIN

This invention relates to a technique for handling grain between the time it is harvested and the time it is delivered to a first conventional buyer and more particularly to a grain bin used to store wet grain prior to drying in the field.

Feed grains, such as corn, wheat and sorghum, are harvested by combines which can cut grain at impressive rates. A modern combine with a 30' head can cut 80,000–100,000# of grain per hour. Grain from the combine is either augered into trucks at the end of a row or is augured, on the run, from the combine into a grain buggy which transports the grain to trucks at the end of the row or a nearby batch grain dryer.

Feed grains and many other granular farm products, such as soybeans, rice, sunflower seeds, rape seed or canola, flax and barley, cannot be stored for any length of time if the moisture content is above a predetermined level. The reason is the grain tends to spoil, rot or germinate. There are only two ways to reduce the moisture content of grain—either allow it to sit in the field until mother nature dries it out or harvest the grain and process the grain through dryers to reduce the moisture content. At one time, all grain was allowed to sit in the field until it dried out. There has been a trend to artificially dry grain because bad things can happen to grain sitting in the field—high winds, big rains, aflatoxin accumulation and the like can reduce a valuable crop to nothing.

There are two kinds of grain drying techniques. Large elevators employ a continuous process whereby wet grain from a large first bin uniformly moves slowly through a drying chamber into a large second bin. Elevators obviously charge farmers a sufficient fee to recover their costs and make as handsome a profit as possible. Not all elevators or shipping facilities have drying capability so farmers do not always have much choice. Batch type dryers are typically much smaller and are typically used in the field by the farmer or a custom combiner. Grain is loaded into the batch dryer and the device started. Grain recirculates inside the dryer and, when the moisture content reaches a predetermined low level, it is discharged into a truck for delivery to the elevator or shipping facility and the process repeated. The economy of operating one or more batch type dryers depends on many variables, most of which are beyond the farmer's control—as seems to be customary. Those items beyond control are: (1) the charges made by the competition, i.e. the elevator, to dry the grain—usually an in fee, a dock charge and an out fee; (2) fuel and labor costs to run the batch dryer and any additional costs to run the concurrent harvest operation; and (3) capital costs of the batch drying operation and any additional costs imposed on the harvest operation. As in many real life situations, there are only a few things that can be improved but these improvements can dramatically affect the economics of a batch grain drying operation.

One of the peculiarities of batch grain dryers is that the capacity of the dryer is not related to the capacity of the combine or harvester with which it is used. Many batch dryers in operation today have capacities of 25,000–40,000# while combines can cut 80,000–100,000#/hour. Batch dryers have a ground level inlet loading hopper near the cylindrical dryer vessel which grain buggies dump into. In these operations, the grain buggies shuttle back and forth between the moving combine and the stationary grain dryer to keep the combine relatively unloaded and the grain dryer loaded and working full time. One would think that two 40,000# batch dryers and two grain buggies would keep up. It never seems to work out right because the grain buggies tend to be full when the combine needs unloading but cannot dump into the dryer because the dryer is not finished with the present batch. Thus, in a harvesting operation using batch grain dryers in the field, the combine is often down because it is waiting on the dryer to cycle and accept another load of grain.

There are several manufacturers of batch type grain dryers, one of which is Moridge Manufacturing, Inc. of Moundridge, KS. Presently available models have 280, 405 and 700 bushel capacities. One manufacturer of stationary and portable grain bins is Lowry Manufacturing Company of Lowry, MN. Portable grain bins used in conjunction with batch type grain dryers are disclosed in U.S. Pat. Nos. 3,726,024 and 4,144,655.

This invention provides one of those improvements which can dramatically affect the efficiency of harvesting operations. In accordance with this invention, a grain bin in the form of a trailer is towed and backed to a location immediately above the batch dryer loading hopper. The grain bin has a bottom dump assembly immediately above the loading hopper which is opened upon command to dump the contents of the grain bin into the loading hopper. The grain buggies load grain from the combine on the run, travel to the dryer and dump into the grain bin. When sufficient grain is accumulated in the bin to load the dryer, the bottom dump is opened to load the dryer and start drying operations. The grain buggies continue to load the bin of this invention and the dryer operator can cycle the dryer as soon as the previous load is delivered to a truck because there is always enough grain in the bin to start another cycle.

The grain bin of this invention provides several advantages. First, the bin provides sufficient temporary storage capacity allowing the combine to operate at its best pace without artificial shut downs imposed by the dryer. Second, the bin provides sufficient temporary storage capacity allowing the dryer to operate at its best pace without artificial shut downs imposed by the combine or grain buggies. Typically, grain harvesting operations start late in the morning after dew has evaporated off the grain and continues until well after dark. Any accumulation of grain in the combine, grain buggies and grain bins can be dried during the night so the next day starts with few or no problems carried over from the previous day.

There are many problems with designing an acceptable grain bin for this particular situation, the disclosures of U.S. Pat. Nos. 3,726,024 and 4,144,655 notwithstanding. It is much preferred that the grain bin of this invention be portable, as free of moving parts as possible and simple. It must have sufficient capacity to buffer operation of the combine from operation of the dryer and vice versa. It must be able to dump into the loading hopper of the batch dryer with a minimum of difficulty.

In one aspect, the portable grain bin of this invention comprises a frame, a plurality of wheels defining an axis of travel of the bin and means for raising and lowering the wheels relative to the frame for supporting the frame on an underlying ground surface, an elongate bin carried by the frame and having a length dimension parallel to the axis of travel and substantially greater than a width dimension and a geometric center at an intersection of a centerline parallel to the length dimension and a centerline parallel to the width dimension, including a bottom dump assembly located between the geometric center and one end of the bin.

In another aspect, this invention comprises a combination of a batch type grain dryer including a ground supporting loading hopper adjacent a vertical drying vessel and a portable grain bin including a frame, a plurality of wheels defining an axis of travel of the bin and means for raising and lowering the wheels relative to the frame for supporting the frame on an underlying ground surface, an elongate bin carried by the frame and having a length dimension parallel to the axis of travel and substantially greater than a width dimension and a geometric center at an intersection of a centerline parallel to the length dimension and a centerline parallel to the width dimension, including a bottom dump assembly located between the geometric center and one end of the bin.

One object of this invention is to provide an improved technique for handling grain during harvesting using a batch type dryer.

Another object of this invention is to provide an improved grain bin for use in a harvesting operation.

These and other objects of this invention will become more fully apparent as this description proceeds, reference being made to the accompanying drawing and appended claims.

IN THE DRAWINGS

Figure 1:
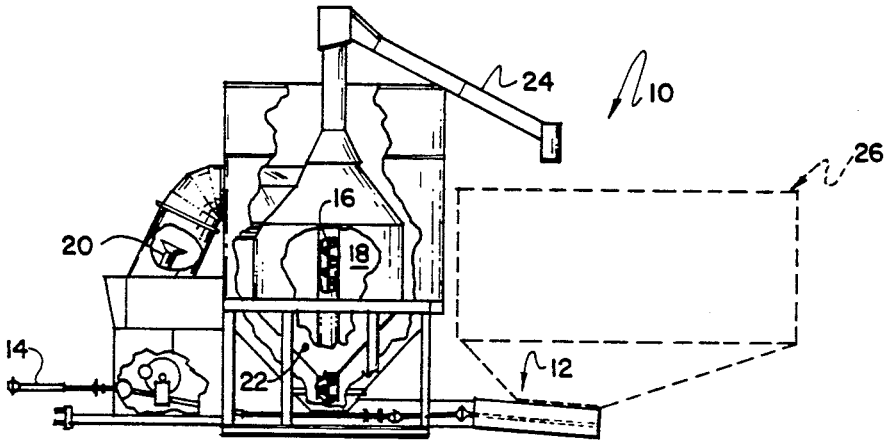
FIG. 1 is a side view, partly in section, of a more-or-less conventional grain dryer in combination with a grain bin of this invention shown in phantom lines.
Figure 2:
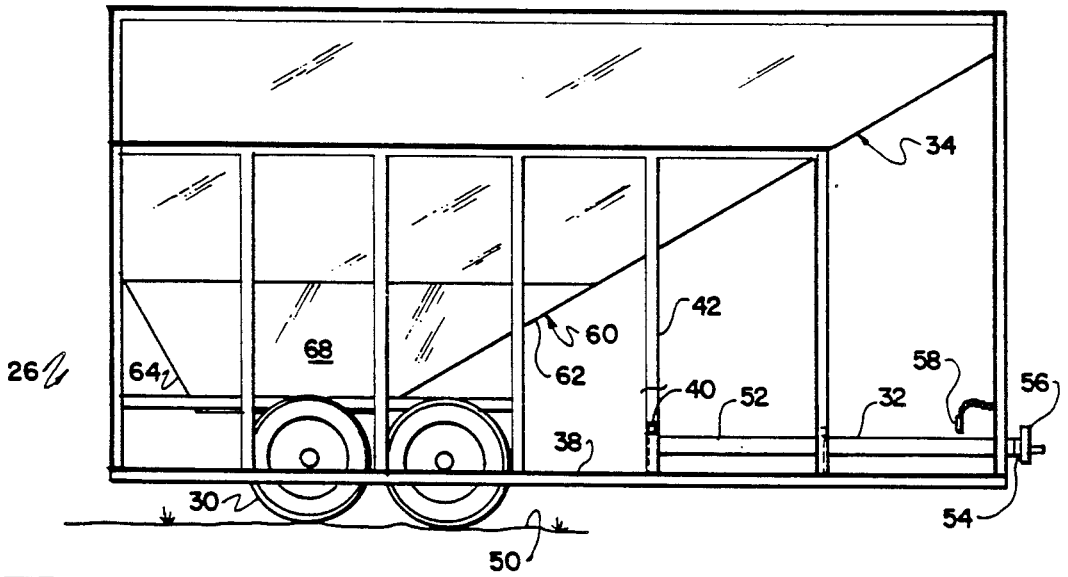
FIG. 2 is a side view of a grain bin of this invention, some parts being broken away for clarity of illustration.
Figure 3:
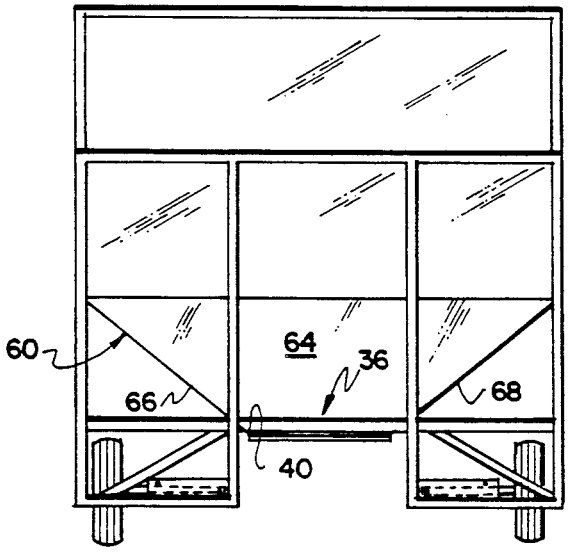
FIG. 3 is an end view of the grain bin of FIG. 2.
Figure 4:
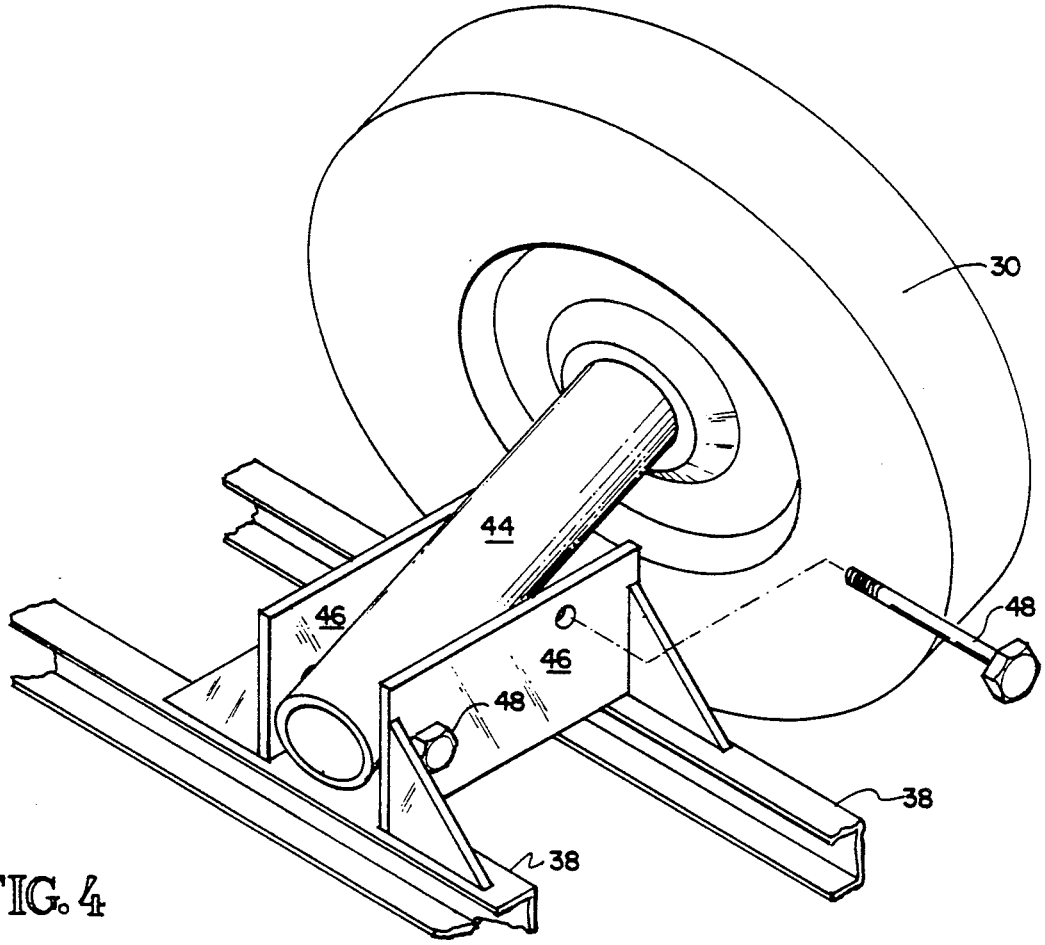
FIG. 4 is an enlarged view of the retractable wheels of the grain bin of this invention.

Referring to FIG. 1, there is illustrated a more-or-less conventional batch grain dryer 10 comprising an input hopper 12 into which a combine (not shown) or grain buggy (not shown) conventionally dumps wet grain. An auger in the hopper 12 is run off a power take off 14 driven by a tractor (not shown) which is used to transport the dryer 10. Grain is augered out of the hopper 12 into a vertical auger 16 and circulates in a vertical plenum 18 while hot air from a burner 20 circulates through the grain. Grain is periodically sampled through a port 22 and tested for moisture content. When grain is dry enough, the output conduit 24 is rotated to one of its two discharge positions, usually 90° from that shown in FIG. 1, so the vertical auger 16 delivers dried grain to a truck under the conduit 24. The truck delivers the grain directly to the port or other transportation facility for sale, bypassing the grain elevator. Elevator handling and drying charges run about $0.60/hundred pounds which is sizeable compared to the price received by the farmer which varies but usually is in the range of $2.50–$4.50 per hundredweight. Those skilled in the art will recognize the dryer 10 as typical of a modern dryer made by Moridge Manufacturing, Inc. of Moundridge, KS. In the event additional information is needed about the dryer 10, reference is made to appropriate publications of Moridge Manufacturing, Inc.

As mentioned previously, the capacities of the dryer 10 and modern combines are not well matched. Typically, the combine can cut much more grain than the dryer can keep up with. Thus, the combine has to shut down and wait until the dryer can accept more grain. Although there are many conceivable solutions, the grain bin 26 of this invention is much preferred.

The grain bin 26 comprises, as major components, a frame 28 having a plurality of lowerable wheels 30 and a trailer hitch 32, a grain receptacle 34 and a bottom dump assembly 36 for selectively dumping grain out of the receptacle 34 into the loading hopper 12 of the dryer 10.

The frame 28 may be of any suitable type and conveniently comprises a plurality of horizontal runners 38 extending in the direction of travel of the grain bin 26 when it is pulled down the road. A plurality of transverse horizontal members 40 extend across the bin 26 and connect with a plurality of vertical members 42. The wheels 30 may be retractable in any suitable fashion, as by rotatably mounting the wheel 30 on a suitable bearing (not shown) on a non-rotating stub axle 44 held between a pair of upright plates 46 by suitable fasteners or pins 48. With the wheels 30 down and the pins 48 in place, the grain bin 26 may be towed with the hitch 32 and positioned so the wheels 30 straddle the inlet hopper 12 of the dryer 10. The outboard pins 48 are then removed, allowing the frame 28 to rest on the underlying ground surface 50. The load of the grain bin 26 and the material placed therein is accordingly transferred to the ground through the horizontal runners 38 and not the wheels 30. This technique for retracting wheels is known in the art and is employed in grain dryers of Moridge Manufacturing, Inc.

The trailer hitch 32 may be of any suitable type and comprises an elongate tubular member 52 welded to the transverse members 40. A second tubular member 54 is retractable into and extendable out of the member 52 and carries a hitch 56 for connection to a tractor, pickup truck or the like. The members 52, 54 are selectively fixed by suitable vertical pins 58.

The grain receptacle 34 is oddly shaped. Typical grain bins, such as made by Lowry Manufacturing Company of Lowry, MN are square because square grain bins use the least material and are the easiest to build, as calculated on a unit of weight or volume. Conventionally shaped grain bins are unsuitable for use with a conventional batch grain dryer. In this invention, the bottom dump assembly 36 is much closer to the rear end of the bin 26 than to the hitch end and the shape of the grain receptacle 34 is distorted to accommodate the position of the bottom dump assembly 36. The bottom walls of the grain receptacle 34 must be inclined to allow wet grain to slide down the bottom walls into the bottom dump assembly 36. Thus, the bottom walls are inclined at a relatively steep angle, at least about 30° and preferably more. In the event wet grain sticks to the bottom of the receptacle 34, it does so on the end between the dump assembly 36 and the hitch 56. The bottom in this area is accessible to the grain dryer operator who can pound on the exposed bottom wall to cause wet sticking grain to slide into the dump assembly 36.

Figure 5:
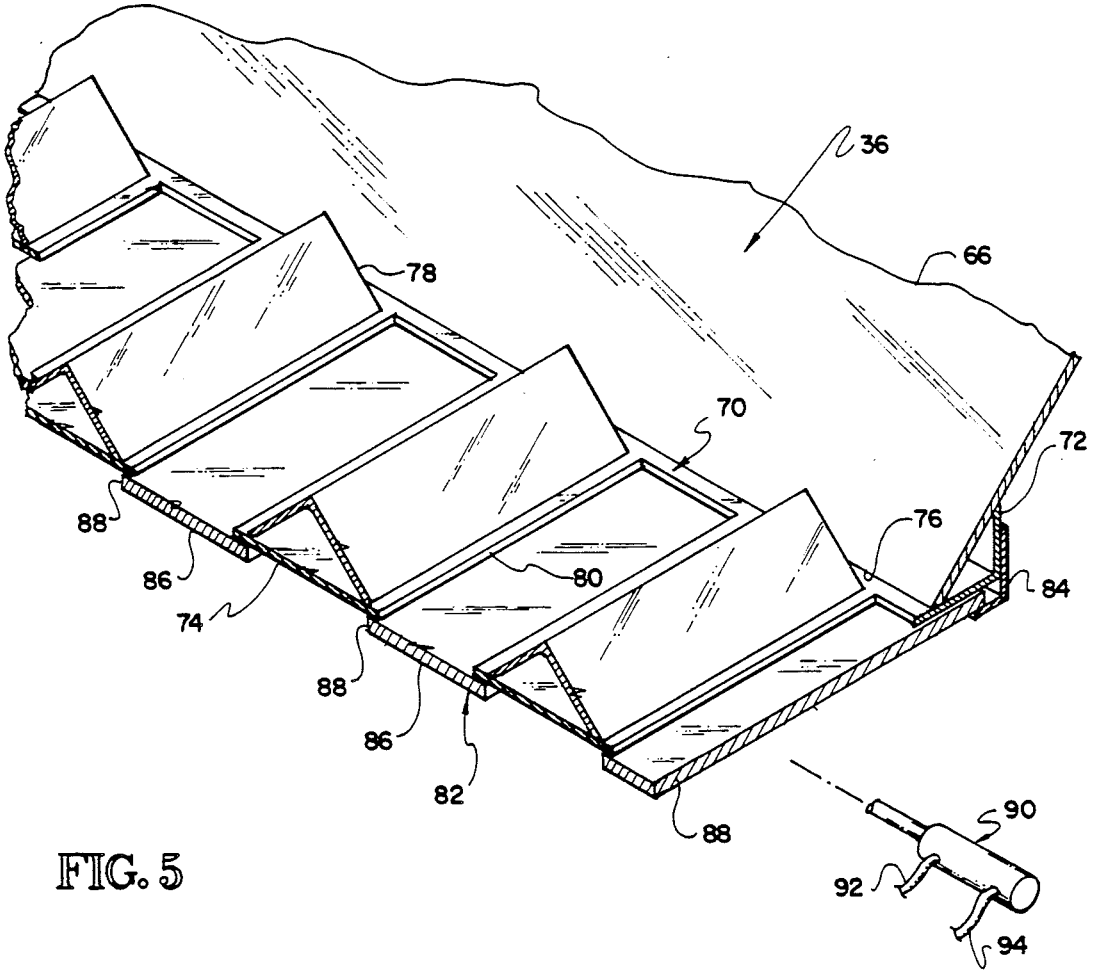
FIG. 5 is an enlarged isometric view, partly in section, of the bottom dump assembly of this invention.

The grain receptacle 34 accordingly includes a small downwardly converging section 60 having inclined bottom walls 62, 64, 66, 68 terminating at the bottom dump assembly 36. As shown best in FIG. 5, the bottom dump assembly 36 comprises a stationary gate 70 including a frame 72 welded to the walls 62, 64, 66, 68 providing a plurality of flat straps 74 extending across a bottom opening 76 provided by the downwardly converging section 60. A triangular shaped structure 78 on top of each of the straps 74 prevents grain from accumulating on the straps 74. The straps 74 are spaced apart to provide a series of slots 80 through which grain falls when a movable gate 82 is moved to a dumping position. The movable gate 82 lies under the stationary gate 70 and is supported by a series of angles 84 welded to the frame 72. The movable gate 82 includes a series of straps 86 having slots 88 therebetween. The gate 82 is movable into an open position in which the slots 80, 88 align to allow grain in the receptacle 34 to fall into the inlet hopper 12 of the grain dryer 10. The gate 82 is movable into a closed position as shown in FIG. 5 in which the straps 74, 86 are offset to close the slots 74, 88 whereby grain in the receptacle 34 stays there.

The gate 82 may be moved in any suitable manner, as by a levered handle (not shown) or a hydraulic motor 90 having a pair of hydraulic lines 92, 94. Although a separate hydraulic system may be provided if desired, it is preferred to connect the lines 92, 94 to the hydraulic system of the same tractor (not shown) used to tow the grain dryer 10 from place to place.

Use of the grain bin 26 of this invention should now be apparent. The grain bin 26 is backed by its towing truck so the wheels 30 straddle the inlet hopper 12 of the grain dryer as shown in dashed lines in FIG. 1. Rather than dumping from the combine (not shown) or grain buggy (not shown) into the hopper 12, just harvested wet grain is dumped into the grain bin 26. The bin 26 is preferably as large as possible so long as it still fits against the grain dryer 10 and preferably is shorter than the height of the discharge end of the chute 24. With a Moridge Model 8770 shown in FIG. 1, having a batch size of about 40,000#, the grain bin 26 holds about 70,000#.

At the end of every harvesting day, the dryer operator continues to operate the dryer 10 until it and the grain bin 26 are empty. When harvesting begins the next morning, the combine (not shown) and/or grain buggy (not shown) dump into the grain bin until the dryer operator comes to work and starts operation of the dryer 10. The operator manipulates the motor 90 and opens the bottom dump gate 36 while driving the power take off 14 from a tractor (not shown). When the dryer 10 has a full load, the gate 36 is closed and a drying cycle starts. As the combine or grain buggy fills up, they drive to the grain bin 26 and dump into it. When the dryer operator has finished drying a batch of grain, the dried grain is delivered to the discharge chute 24 to a waiting truck and the cycle is started again.

At the end of the harvesting day, the combine and/or grain buggy dump into the grain bin 26. Operation of the dryer 10 continues until all of the harvested grain is dried and trucked away. By sizing the grain dryer 10, the grain bin 26 and the combine, sufficient storage capacity is provided so the combine can be operated more-or-less continuously without waiting on the drying operation.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A portable grain bin trailer comprising a farm having a front end and a rear end, a plurality of wheels, a trailer hitch on the front frame an end defining a normal path of towing movement of the grain bin trailer along an underlying surface and means for raising and lowering the wheels relative to the frame;

a bin carried by the frame and including a front end adjacent the frame front end and a rear end adjacent the frame rear end, a bottom dump assembly located substantially closer to the rear bin end than to the front bin end, the bottom dump assembly comprising a plurality of spaced stationary slats providing a plurality of spaced first openings therebetween, a movable gate comprising a plurality of movable slats providing a plurality of spaced second openings therebetween nd means for moving the gate from a first position where the first and second openings are aligned to a second position where the second slats close the first openings, the first slats being triangular in cross-section having an upwardly facing apex and a horizontal base, the horizontal bases being coplanar, the second slats being coplanar and abutting the horizontal bases, a downwardly convergent bottom wall having an opening merging with the bottom dump assembly and an upper end, a pair of spaced upright side walls extending between the front and rear bin ends and merging with the bottom wall upper end, a first upright end wall on the rear bin end merging with the bottom wall upper end, merging with the upright side walls and defining a first angle with the underlying surface, the first upright end wall comprising the rear terminus of the trailer, and a second inclined end wall on the front bin end merging with the bottom wall upper end, merging with the upright side walls and defining a second angle with the vertical much smaller than the first angle.

2. The portable grain bin of claim 1 wherein the wheels define an axis of travel of the grain bin, the side walls being parallel to the axis of travel.

3. The portable grain bin of claim 1 wherein the wheels define an axis of travel and the bottom dump assembly provides a length dimension parallel to the axis of tavel and a smaller width dimension transverse to the axis of travel.

4. The portable grain bin of claim 3 wherein the wheels comprise a wheel on opposite sides of the grain bin, the wheels straddling the bottom dump assembly.

5. In combination, a batch type grain dryer including a frame, a plurality of wheels defining an axis of travel of the dryer and means for raising and lowering the wheels relative to the frame for supporting the frame on an underlying ground surface;

an upright vessel on the frame having means for circulating grain in the vessel;

means for heating grain in the vessel and evaporating moisture therefrom;

means for circulating air through the vessel;
means for discharging grain from the vessel; and
means for delivering grain into the vessel comprising a ground supported loading hopper and a conveyor for transporting grain from the hopper into the vessel; and a portable grain bin trailer independent o the batch type grain dryer including a frame having a front end and a rear end, a plurality of wheels defining an axis of travel of the bin, a trailer hitch on the front frame end defining a forward path of movement of the grain bin trailer, and means for raising and lowering the wheels relative to the frame for supporting the frame on an underlying ground surface;

an elongate bin carried by the frame and having a length dimension parallel to the axis of travel and substantially greater than a width dimension a nd a geometric center at an intersection of a centerline parallel to the length dimension and a centerline parallel to the width dimension, including a front end adjacent the frame front end and a rear end adjacent the frame rear end, an upright end wall on the rear bin end comprising the rear terminus of the trailer, and a bottom dump assembly located between the geometric center of the bin and the rear end of the bin, the bottom dump assembly being located immediately above the loading hopper and the first end of the bin being juxtaposed to the drying vessel, the bottom dump assembly comprising a plurality of spaced stationary slats providing a plurality of spaced first openings therebetween, a movable gate comprising a plurality of movable slats providing a plurality of spaced second openings therebetween and means for moving the gate from a first position wherein the first and second openings are aligned to a second position where the second slats close the fist openings, the first slats being triangular in cross-section having an upwardly facing apex and a horizontal base, the horizontal bases being coplanar, the second slats being coplanar and abutting the horizontal bases.

6. The portable grain bin of claim 5 wherein the bin comprises a downwardly convergent bottom wall having a bottom opening closer to the rear bin end than o the front bin end and an upper end, a pair of spaced upright side walls extending between the first and second bin ends and merging with the bottom wall upper end, a first upright end wall on the rear bin end merging with the bottom wall upper end, merging with the side walls and defining a first angle with the underlying surface, the first upright end wall comprising the rear terminus of the trailer, and a second end wall on the front bin end merging with the bottom wall upper end, merging with the side walls and defining a second angle with the vertical much smaller than the first angle, the bottom dump assembly closing the bottom opening.

7. The portable grain bin of claim 6 wherein the wheels define an axis of travel and the bottom dump assembly provides a length dimension parallel to the axis of travel and a smaller width dimension transverse to the axis of travel.

8. A portable grain bin comprising a frame, a plurality of wheels and means of raising and lowering the wheels relative to the frame;

a bin carried by the frame and including first and second ends, a bottom dump assembly, located substantially closer to the first end than to the second end, comprising a plurality of spaced stationary first slats, triangular in cross section having upwardly facing apices and horizontal coplanar bases, providing a plurality of spaced first openings therebetween, a movable gate comprising a plurality of movable coplanar second slats abutting the first slat bases and providing ac plurality of spaced second openings therebetween and means for moving the gate from a first position where the first and second openings are aligned to a second position where the second slats close the first openings, a downwardly convergent bottom wall having an opening merging with the bottom dump assembly and an upper end, a pair of spaced upright side walls extending between the first and second bin ends and merging with the bottom wall upper rend, a first inclined end wall on the first bin end merging with the bottom wall upper end and defining a first angle with the vertical, and a second end wall on the second bin end merging with the bottom wall upper end and defining a second angle with the vertical much smaller than the first angle.

9. In combination, a batch type grain dryer including a frame, a plurality of wheels defining an axis of travel of the dryer and means for raising and lowering the wheels relative to the frame for supporting the frame on an underlying ground surface;

an upright vessel on the frame having means for circulating grain in the vessel;

means for heating grain in the vessel and evaporating moisture therefrom;

means for circulating air through the vessel;

means for discharging grain from the vessel; and means for delivering grain into the vessel comprising a ground supported loading hopper and a conveyor for transporting grain from the hopper into the vessel; and a portable grain bin including a frame, a plurality of wheels defining an axis of travel of the bin and means for raising and lowering the wheels relative to the frame for supporting the frame on an underlying ground surface;

an elongate bin a carried by the flame and having a length dimension parallel to the axis of travel and substantially greater than a width dimension and a geometric center at an intersection of a centerline parallel to the length dimension and a centerline parallel to the width dimension, including a bottom dump assembly located between the geometric center and a first end of the bin, the bottom dump assembly being located immediately above the loading hopper and the first end of the bin being juxtaposed of the drying vessel, the bottom dump assembly comprising a plurality of spaced stationary first slats, triangular in cross section having an upwardly facing apices and horizontal coplanar bases, providing a plurality of spaced first openings therebetween, a movable gate comprising a plurality of movable coplanar second slats abutting the first slat bases and providing a plurality of spaced second openings therebetween and means for moving the gage from a first position where the first and second openings are aligned to a second position where the second slates close the first openings.

* * * * *